US005174097A

United States Patent [19]

Muratore

[11] Patent Number: 5,174,097

[45] Date of Patent: Dec. 29, 1992

[54] HEADSTALL

[76] Inventor: Vincent Muratore, 3 Milewa Ct., Mornington, Victoria 3931, Australia

[21] Appl. No.: 727,469

[22] Filed: Jul. 9, 1991

[30] Foreign Application Priority Data

Jul. 13, 1990 [AU] Australia ..... PK1174

[51] Int. Cl.[5] ..... B68B 1/04

[52] U.S. Cl. ..... 54/6.1; 2/311

[58] Field of Search ..... 54/6 R, 6 A, 24; 119/106; 2/311, 312, 318

[56] References Cited

U.S. PATENT DOCUMENTS 1,053,764 2/1913 Wiberley ..... 2/311
1,340,271 5/1920 Jensen ..... 54/24
3,407,568 10/1968 Henry ..... 54/24
4,518,107 5/1985 Ames ..... 224/215
4,924,815 5/1990 Halla ..... 119/106
4,996,948 3/1991 Klein et al. ..... 119/106

FOREIGN PATENT DOCUMENTS 7559287 1/1988 Australia .

*Primary Examiner*—Robert P. Swiatek
*Attorney, Agent, or Firm*—Evenson, Wands, Edwards, Lenahan & McKeown

[57] ABSTRACT

A combination clothing belt and animal headstall device (10) in which an intermediate portion (19) of the belt comprises two strap-like portions (20), (21) which, in the headstall configuration, part to form a loop to encircle the nose of the animal whilst the end portions (11/24) (14) of the belt cooperate to encircle and hold the head of the animal.

10 Claims, 3 Drawing Sheets

HEADSTALL

FIELD OF THE INVENTION

This invention relates to a device which doubles as a clothing belt and a muzzle or headstall device which can be used as a temporary device for "bridling" and leading an animal such as a horse. The invention will be described herein in relation to such a belt and headstall for a horse but is not restricted to use with such an animal.

It is often desired to control and lead a horse, for example, by means of a bridle or a headstall device when no such device is readily available. It is an object of the present invention to provide a device which can be worn by a person as a normal clothing belt and removed when required to form a headstall device for temporarily controlling and leading an animal such as a horse.

SUMMARY OF THE INVENTION

The present invention therefore provides a combination belt and animal headstall device which comprises first and second elongate belt portions separated by an intermediate belt-like portion comprising two or more elongated strap-like portions, said first and second elongate belt portions having attachment means forming cooperating belt connection means adapted to secure the device in a belt configuration said strap-like portions being movable to enable the strap-like portions to encircle the nose of the animal when the device is in a headstall configuration said first and second belt portions being extendable in length to enable the portions to extend behind and to be attached to the head of the animal.

The present invention also provides a combination belt and animal headstall device which comprises first and second elongate belt portions separated by an intermediate belt-like portion comprising two or more elongate strap-like portions, said first and second elongate belt portions having attachment means forming cooperating belt connection means: said strap-like portions being moveable to enable the strap-like portions to encircle the nose of the animal; and said first and second belt portions being entendable in combined length to enable the portions to extend behind and to be secured to the head of the animal when the device is in the headstall configuration.

Preferably the attachment means comprises a buckle on the first belt portion which is releasably attached at any one of a plurality of positions along the length of the first belt portion to enable the device to be lengthened to accommodate the head of the animal when the device is in a headstall configuration.

Preferably the attachment means comprises a buckle on the first belt portion which is releasably attached at any one of a plurality of positions along the length of the first belt portion to enable the device, when in a belt configuration to be worn by a person, to be adjusted in length to accommodate persons of differing girth.

Preferably the buckle is in a position between the end of the belt portion attached to the intermediate portion and the other end of the belt portion preferably the portion of the belt which extends beyond the buckle folds back against itself at or about the position of the buckle.

Preferably the intermediate elongate belt portion comprises two elongate strap members of combined width approximately equal to the width of the first and second elongate belt portions. Alternating the intermediate elongate belt portion comprises two chains either of metal or synthetic plastics material of suitable strength characteristics. In a further alternative the intermediate elongate belt portion comprises two ropes or cords of the natural or synthetic plastic material fibres attached in known manner to the first and second elongate belt portions.

Preferred forms of the device of the invention will now be described with reference to the accompanying drawings.

DETAILED DESCRIPTION OF PREFERRED EMBODIMENTS

Figures 1, 2, 3, 4, 5, 6:
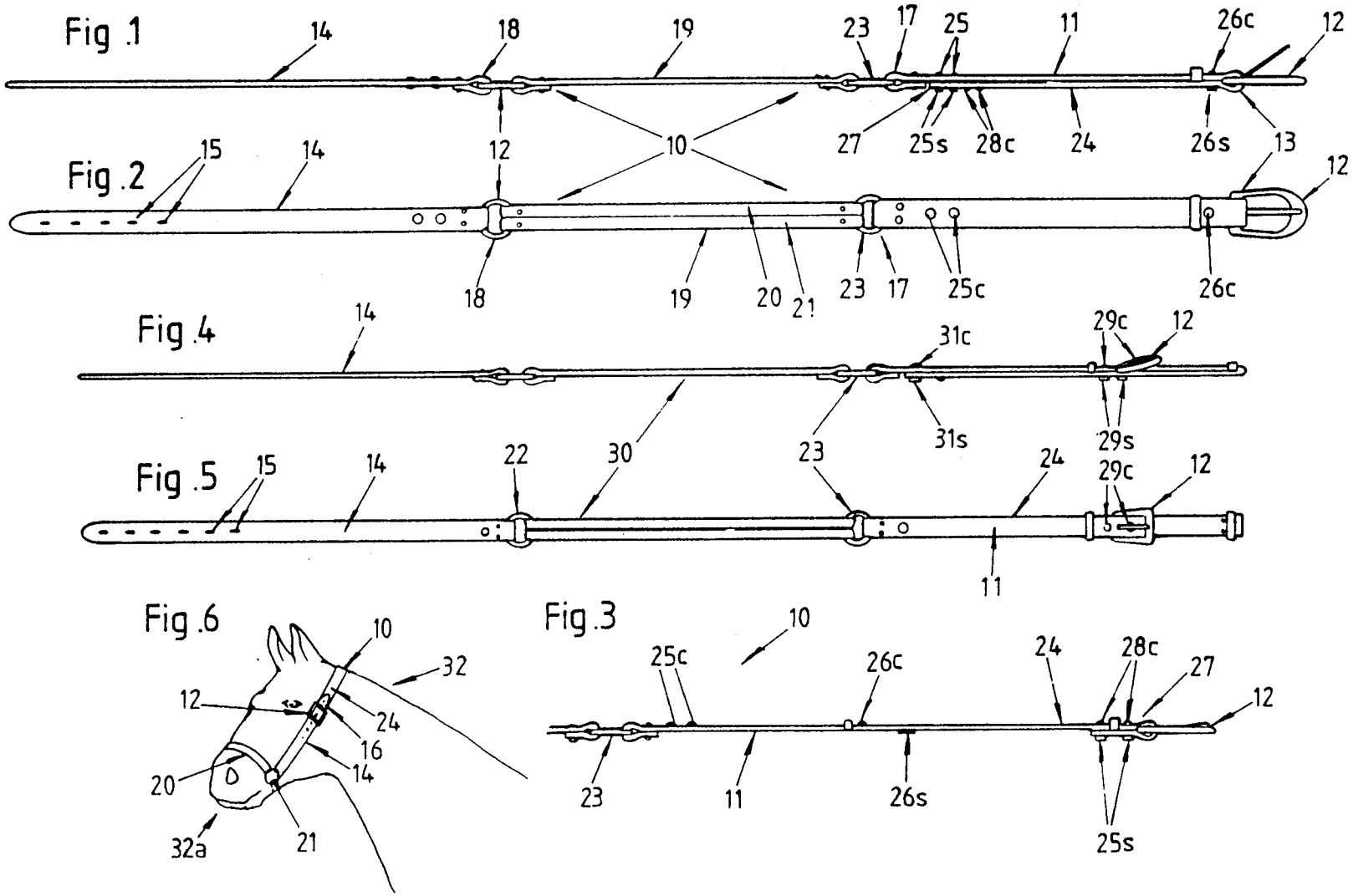
FIG. 1 is a side view of a belt and headstall device according to the invention shown in a belt configuration.
FIG. 2 is a plan view of the device of FIG. 1.
FIG. 3 shows a partial side view of the device of FIG. 1 and 2 in an extended configuration.
FIG. 4 is a side view of an alternative belt and headstall device according to the invention.
FIG. 5 is a plan view of the device of FIG. 4.
FIG. 6 shows the device of FIGS. 1 to 3 in situ in the headstall configuration.

Referring to FIGS. 1, 2 and 3 there is shown a belt and headstall device 10 of the present invention in belt form. The device comprises an elongated first belt portion 11 having a buckle 12 attached at one end 13 and a second belt portion 14 having a plurality of buckle engagement holes 15 disposed towards one end 16 thereof. The other ends 17, 18 of the first and second belt portions are joined by an intermediate belt portion 19 having at least two strap means 20, 21 joined by means of rings 22, 23. The strap means are formed and joined to the rings so that they lie substantially parallel to each other and co-linear with the first and second belt portions when the device is in the belt configuration. The belt portions may be attached to the rings by any means known in the art such as by studs or by sewing or glueing. The second belt portion includes as indicated a plurality of buckle holes 15 to cooperate in known manner with buckle 12 and enable adjustment of the belt as is customary to fit persons of different stature. The first belt portion includes as indicated a buckle 12 which may be releasably attached as described later (or may be releasably engaged in one or more positions) to allow increase in the length of the belt and headstall device from the belt configuration as shown to the headstall configuration as will be described later. Such increase in length of the belt may be accomplished by providing additional first belt portion 24 integral with first belt portion 11 and which lies adjacent to and inside the first belt portion and is releasably attached thereto by studs 25*s* and clip 25*c*. The first belt portion and additional belt portion encircle and hold buckle 12 in known manner and hold the buckle in place by means of stud 26*s* and clip means 26*c*.

As shown in FIG. 3 the device 10 can be extended in that the first belt portion 11 may be lengthened by unclipping the stud and clip means 25*c*, 25*s* and stud clip means 26*c*, 26*s* and fixing the buckle at about the end 27 of the additional first belt portion 24 by means of stud 25*s* and clip 28*c*. The length of the extended first belt portion is thus approximately doubled to provide increased length in the combined belt portions to enable the belt portions of the device to extend around the head of the animal to which is is to be fitted.

Referring to FIGS. 4 and 5 there is shown an alternative configuration of belt and headstall device 30 similar to that described in relation to FIGS. 1, 2 and 3 with the buckle 12 shown attached by means of studs 29*s* and clip means 29*c* midway along first belt portion 11 and additional belt portion 24 The first belt portion 11 and additional belt portion 24 are releasably secured as before at or near ring 23 by stud 31*s* and clip means 31*c*. Thus it possible to construct a belt for a person of shorter stature or smaller build which still is convertible to a headstall configuration of sufficient length when extended in similar manner as described in relation to FIG. 6 later.

Referring to FIG. 6 there is shown a belt and halter combination in the halter configuration attached in position on a horse.

The belt and halter device 10 is shown in the halter configuration on a horse (head) 32. The belt portions (11 and 24 of FIG. 1) are in the extended configuration as shown in FIG. 3 and the end 16 of the belt portion 14 is attached to buckle 12 to attach the device in place as shown. The strap means 20, 21 of the intermediate belt portion are separated as shown to encircle the nose 32*a* of the horse.

Figure 7:
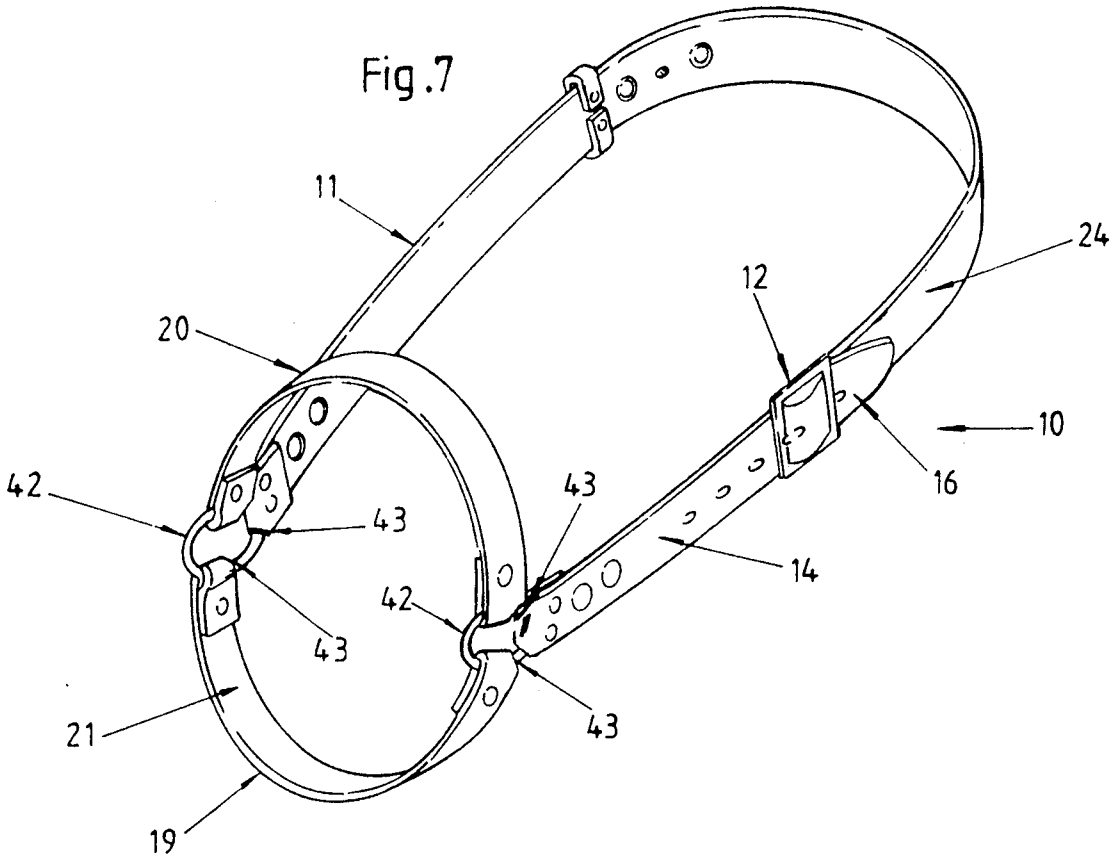
FIG. 7 shows the device of FIG. 6 in greater detail.

FIG. 7 shows the device 10 of FIG. 6 in greater detail to show further preferred features of the invention. The extended first and second belt portions 14 and 16 are connected by way of buckle 12. The first and second belt portions 14, 11 and 24 are attached to intermediate belt sections 20 and 21 by way of rings 42. The edges of the first and second belt portions 11 and 14 and the edges of the intermediate belt sections 20 and 21 are preferably cut to a bevel edge 43 to enable the intermediate belt sections to readily part and assume the headstall configuration in which the angle between the first and second belts on the onehand and the intermediate belt sections are disposed substantially at right angles in the vicinity of the rings 42.

Figure 8:
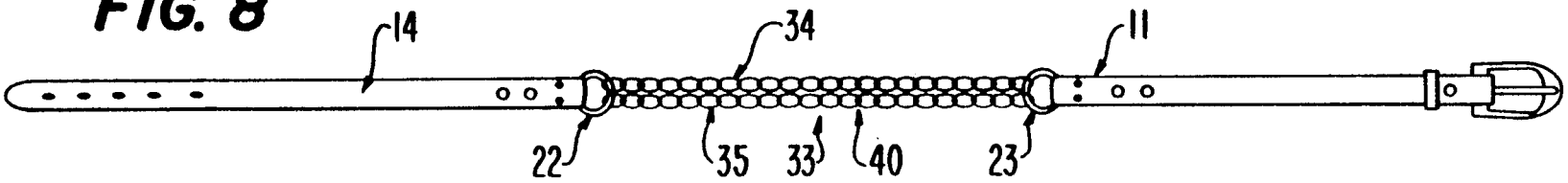
FIG. 8 shows a view of an alternative construction of belt and headstall device according to the invention.

Referring to FIG. 8, there is shown a partial plan view of a belt and headstall device 40 similar that shown in FIGS. 1 to 3. The belt and headstall device 40 includes first and second belt portions 11 and 14 as per FIG. 1 attached to intermediate elongate belt like portion 33 by means of metal rings 22, 23. The belt portion 33 comprises two lengths of chain 34 and 35 which are attached only at each end to the rings 22 and 23. The chains can then readily be parted to form a loop as previously described to encircle the nose of a horse or other animal to be lead.

Figure 9:
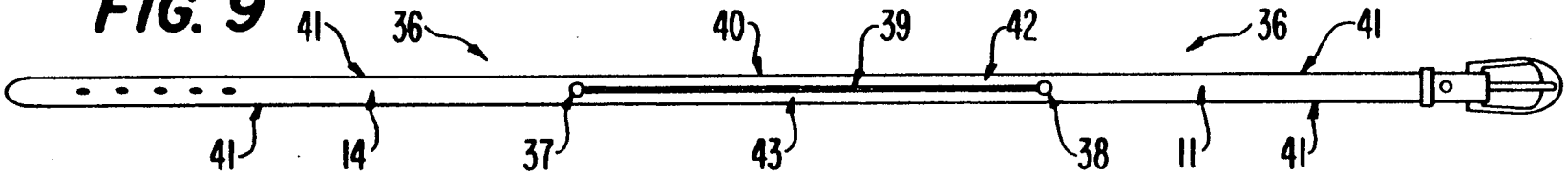
FIG. 9 shows a further alternative construction of belt and headstall device according to the invention.

FIG. 9 shows a further alternative construction of belt and headstall device 36 according to the invention. The first and second belt portions 11, 14 and intermediate elongate belt portion are formed from a single strap of leather by provision of two holes 37. 38 through the belt. The holes 37 and 38 are formed by slit 39 also through the belt parallel to the sides or edges 41 of the belt to provide the two intermediate strap portions 42, 43 which are parted to form the animal nose encircling loop as previously described.

It will be readily apparent that a belt and headstall device may be constructed which combines the features of FIGS. 1 to 3 and 4 and 5 The belt and headstall device of FIGS. 1, 2 and 3 may be modified so that the buckle 12 may be positioned on end 13 of the first belt portion or part way between end 17 and end 13 by provision of additional stud and clip means 29 as described in relation to FIGS. 4 and 5 as well as being positioned, in the headstall extended configuration, at or near end 27 of the additional first belt position.

The belt and halter device may be made of any convenient textile or other suitable material with leather being the preferred material. The rings and stud and clip combination may be made of any suitable material such as plastics materials or metal. The intermediate belt section may comprise three or more strap means; two of which encircle the nose of the animal to be controlled or lead. The strap means may comprise as indicated leather strips, rope, cord or chain or any other suitable material.

Other straps or hand grips may be attached to the rings of the belt and halter device to readily enable the animal to be lead by hand. Other strap devices may be provided to releasably attach to, for example, one or other of the rings to provide appropriate hand grip means.

The connection of the first, second and intermediate belt portions has been described utilizing metal rings, for example. It is obviously an alternative procedure to merely separate the strips of the intermediate belt portion by appropriate splitting of the complete belt length at the appropriate position or section of the length of the belt.

The preferred means of attaching the device either in the belt or in the headstall configuration is by way of a conventional belt buckle. It will be appreciated that the attachment means may include Velcro-type fastening means or any other suitable means known in the art.

Other variations and modifications may be made without departing from the spirit of the invention disclosed herein.

I claim:

1. A combination human belt and animal headstall device which comprises first and second elongate belt portions separated by an intermediate belt-like portion comprising two or more elongated strap-like portions, said first and second elongate belt portions having attachment means forming cooperating belt connection means adapted to secure the device in a human belt configuration for human use, said strap-like portions being movable to enable the strap-like portions to encircle the nose of the animal when the device is in a headstall configuration, said first and second belt portions being extendable in combined length to enable the portions to extend behind and to be attached around the head of the animal.

2. A device as claimed in claim 1 in which the attachment means comprises a buckle on the first belt portion which is releasably attached at any one of a plurality of positions along the length of the first belt position to enable the device to be lengthened to accommodate the head of the animal when the device is in a headstall configuration.

3. A device as claimed in claim 1 in which the attachment means comprises a buckle on the first belt portion which is releasably attached at any one of a plurality of positions along the length of the first belt portion to enable the device, when in a belt configuration to be worn by a person, to be adjusted in length to accommodate persons of differing girth.

4. A device as claimed in claim 3 in which the buckle is in a position between the end of the belt portion attached to the intermediate portion and the other end of the belt portion.

5. A device as claimed in claim 4 in which the portion of the belt which extends beyond the buckle folds back against itself at or about the position of the buckle.

6. A combination human belt and animal headstall device which comprises first and second elongate belt portions separated by an intermediate belt-like portion comprising two or more elongate strap-like portions, said first and second elongate belt portions having attachment means forming cooperating belt connection means; said strap-like portions being moveable to enable the strap-like portions to encircle the nose of the animal; and said first and second belt portions being extendable in combined length to enable the portions to extend and be secured behind the head of the animal when the device is in the headstall configuration.

7. A device as claimed in claim 6 in which the attachment means comprises a buckle on the first belt portion which is releasably attached at any one of a plurality of positions along the length of the first belt portion to enable the device to be lengthened to accommodate the head of the animal when the device is in a headstall configuration.

8. A device as claimed in claim 6 in which the attachment means comprises a buckle on the first belt portion which is releasably attached at any one of a plurality of positions along the length of the first belt portion to enable the device, when in a belt configuration to be worn by a person, to be adjusted in length to accommodate persons of differing girth.

9. A device as claimed in claim 8 in which the buckle is in a position between the end of the belt portion attached to the intermediate portion and the other end of the belt portion.

10. A device as claimed in claim 9 in which the portion of the belt which extends beyond the buckle folds back against itself at or about the position of the buckle.

* * * * *